US006161978A

United States Patent [19]

Dovellos

[11] Patent Number: 6,161,978

[45] Date of Patent: Dec. 19, 2000

[54] INTERCHANGEABLE CAP FLUID APPLICATOR

[76] Inventor: George M. Dovellos, 1328 Mulrfield Dr., Schererville, Ind. 46375

[21] Appl. No.: 09/272,640

[22] Filed: Mar. 18, 1999

[51] Int. Cl.[7] ..... A46B 11/04

[52] U.S. Cl. ..... 401/288; 401/282; 401/271

[58] Field of Search ..... 401/288, 282, 401/286, 287, 289, 268, 269, 270, 198, 283; 15/104–94

[56] References Cited

U.S. PATENT DOCUMENTS

| | | | |
|---|---|---|---|
| 140,228 | 6/1873 | Wentworth . | |
| 602,204 | 4/1898 | Weis | 401/269 |
| 1,030,137 | 6/1912 | Smith . | |
| 1,641,865 | 9/1927 | Rabalais . | |
| 1,899,984 | 3/1933 | Powell . | |
| 2,505,441 | 7/1946 | Tavermer | 401/271 |
| 3,369,854 | 2/1968 | Ferris . | |
| 3,378,331 | 4/1968 | Beasley | 401/286 |
| 4,279,527 | 7/1981 | Moe et al. | 401/277 |
| 4,447,169 | 5/1984 | Vartoughian . | |
| 4,908,902 | 3/1990 | McNab et al. | 15/159 R |
| 4,930,923 | 6/1990 | Reichmann et al. . | |
| 4,940,351 | 7/1990 | Konose . | |
| 5,066,157 | 11/1991 | Liff | 401/288 |
| 5,271,513 | 12/1993 | Crosnier et al. | 215/320 |
| 5,403,107 | 4/1995 | Griffith et al. . | |

FOREIGN PATENT DOCUMENTS 1925385 12/1969 Germany .

OTHER PUBLICATIONS

Advertising, *American Artist*, p. 72—"Believed to have been published prior to filing of application".

*Primary Examiner*—Henry J. Recla
*Assistant Examiner*—Huyen Le
*Attorney, Agent, or Firm*—Brinks Hofer Gilson & Lione

[57] ABSTRACT

An interchangeable cap with a brush applicator. The brush is mounted to a cap adapted to fit a standard acrylic paint bottle. A ferrule holds the brush to the cap. Within the ferrule, a plurality of dispensing tubes fluidly connect the paint contained in the bottle to the bristles of the brush. By deforming the bottle, paint is fed to the brush needles for application to an object.

18 Claims, 3 Drawing Sheets

INTERCHANGEABLE CAP FLUID APPLICATOR

BACKGROUND OF THE INVENTION

This invention relates to fluid applicators, and, more particularly, to applicator brushes for acrylic craft paints.

Many people enjoy arts and crafts, particularly crafts involving painting using acrylic paints. Since acrylic paints are commonly used in a variety of crafts, the acrylic paint industry has adopted a regularly used standard size acrylic paint bottle. Often, acrylic paints can be purchased in two-ounce bottles. These bottles are generally deformable; that is, their shape can be easily and non-permanently altered. For example, they can be "squeezed" thereby allowing for advancement and dispersion of the paint contained in the bottle onto the surface of the object to be painted.

In that most acrylic paint bottles usually contain a volume of two ounces, the bottles have a generally consistent size and shape. They frequently are small enough to be manipulated in one hand by the user. Commonly, the opening to the paint bottles from which the paint is dispersed or the bottle filled is of consistent sizes so that the caps sold with the paint bottles are generally interchangeable.

In order to paint using the two-ounce size bottles of acrylic paints, many of the bottles include a threaded cap having a flip-top lid and a small opening formed in the cap under the lid. In order to use the paint contained in such bottles, the user must first squeeze the paint through the opening onto a separate conventional paintbrush or into a separate container or pallet. In some bottle configurations, the cap must be removed from the bottle and set aside while a separate brush must be inserted into the mouth and cavity of the bottle holding the paint. This could lead to contaminants being introduced into the paint (for example, if the same brush is dipped into two or more colors of acrylics therefore fading the true hue of the paints). During any of these actions, the paint bottle may tip over and spill. Furthermore, the use of pallets, containers and other brushes leaves many items that must be cleaned or discarded after use. Therefore, crafters have long been in search of a new and useful paintbrush and method of applying acrylic paint that would solve these and other problems associated with the prior art.

Additionally, the use of a new, non-obvious, and useful paintbrush has long been sought after by cosmetic users and those that varnish or apply base coats.

These and other problems associated with the prior art are solved by the present invention.

BRIEF SUMMARY OF THE INVENTION

The present invention relates to an apparatus for applying a fluid including a deformable container containing a fluid, a cap for covering the deformable container, an applicator joined to the cap, and at least one dispensing mechanism in fluid communication among the container, the cap, and the application for dispensing the fluid held in the container onto an object.

The present invention relates to a method of providing a fluid including the steps of providing a plurality of fluid bottles, each of the bottles having a cap for sealing within the bottle the contents of the bottle, removing the cap from the bottle, attaching a cap fluid applicator of the present invention to the bottle, deforming the bottle so as to advance the fluid contained within the bottle, and applying the fluid to an object to be painted.

As one advantage of the invention, the invention provides an easy and efficient apparatus to dispense a fluid without wasting the fluid.

As a further advantage of the invention, the invention provides an easy method to apply a fluid while reducing the possibility of spilling the fluid.

Further, the invention provides an apparatus for economically dispensing a fluid without excessive dripping of the fluid.

As a further advantage of one embodiment of the invention, the bristles of the invention are easy to clean since the tubes leading to the distal end of the ferrule do not extend into the bristles. Therefore, there is no impediment to the thorough cleaning of the bristles.

As a further advantage of one embodiment of the present invention, the cap is interchangeable with a plurality of differently sized bottles.

DETAILED DESCRIPTION OF THE PREFERRED EMBODIMENT

Figure 4:
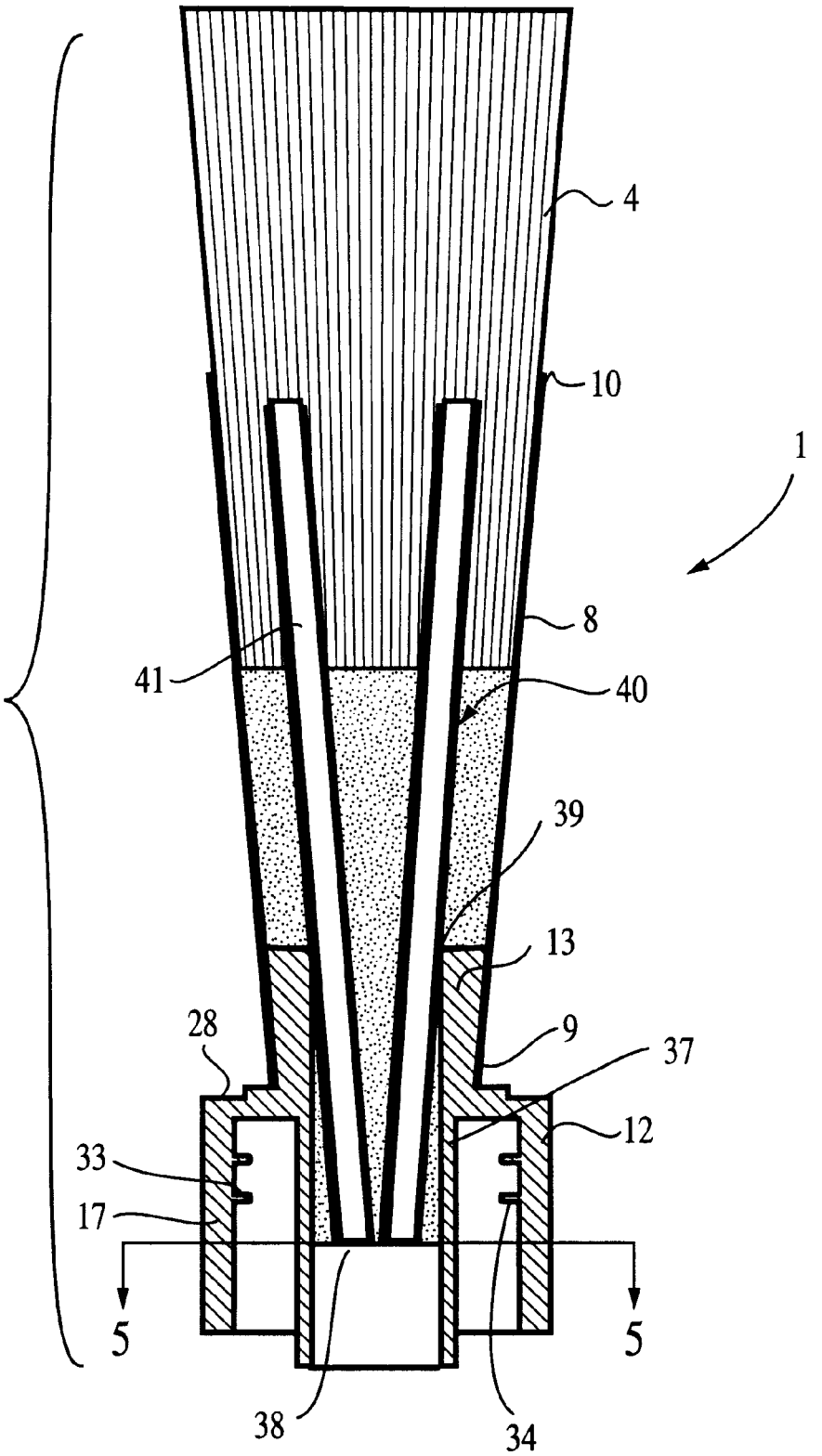
FIG. 4 is a close up view of a cross section of the brush and ferrule of one embodiment of the present invention.

As shown in FIG. 4, the invention relates to an interchangeable cap fluid applicator system 1 for use with acrylic paints including a brush 4, held within a ferrule 8, for application of the paint, a cap 12 to which the brush 4 is attached and which is engageable with a standard acrylic paint bottle 16, and at least one dispensing tube 40 for dispensing the acrylic paint from the bottle 16, through the cap 12 and ferrule 8, and to the brush 4 for application to an object to be painted.

Figure 1:
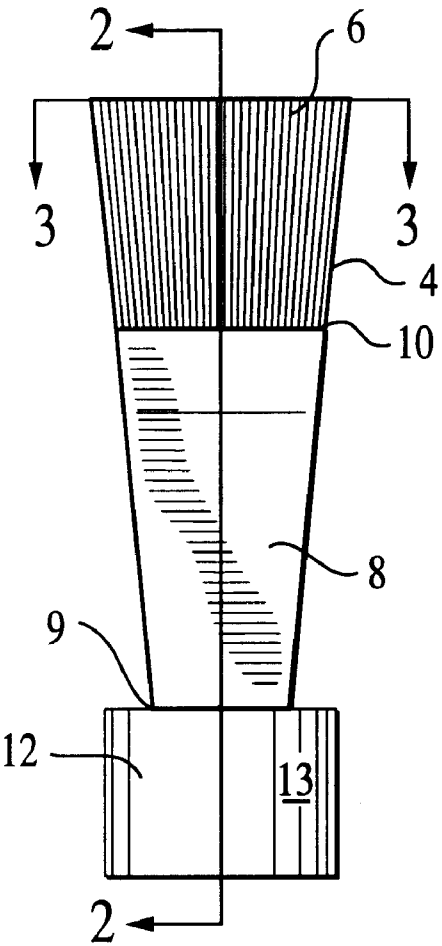
FIG. 1 is a front view of the brush and cap of the embodiment of the present invention.

As shown in FIG. 1, in the illustrated embodiment, the brush 4 includes a plurality of bristles 6. The bristles 6 may be made of synthetic or natural materials. For example, the bristles 6 may be made of human, animal hair, or synthetic filament Poly Butylene Terephthalate (PBT).

In a further embodiment, the brush 4 may have a variety of tips ranging from a flat broad tip for applying a base coat to a round fine tip for precise work.

In yet another embodiment, the brush 4 may be replaced with a synthetic or natural sponge applicator (not shown). It is envisioned that a plurality of different applicators, including but not limited to cloth and wire bristles or mesh, may be interchangeable with the brush 4 of one embodiment of the present invention.

Figure 3:
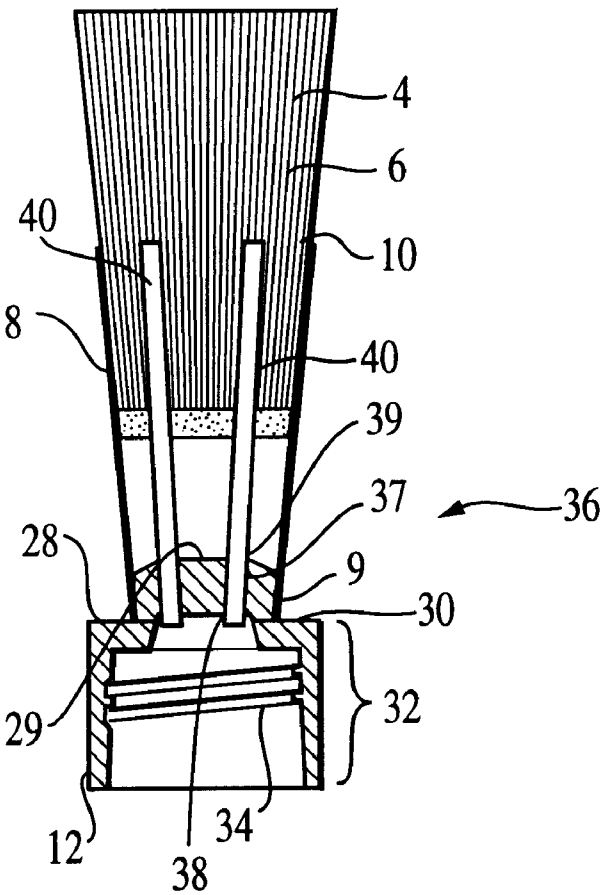
FIG. 3 is a cross section along line 3—3 of FIG. 1 of the brush and cap of one embodiment of the present invention.

As shown in FIGS. 3 and 4, in the illustrated embodiment, the ferrule 8 holds a plurality of bristles 6 which form the brush 4. The ferrule 8 includes a proximal 9 and a distal end 10. The proximal end 9 is attached to the exterior surface 13 of the top portion 28 of the cap 12. The ferrule 8 may have a broad proximal base and taper to a narrower than the base distal end. The ferrule 8 may be constructed of plastic or metal.

In one embodiment, the ferrule 8 is molded to the cap 12 to attach it to the cap 12. In yet other renditions of the invention, the ferrule 8 may be attached to the cap 12 by various mechanisms, including, but not limited to, a plurality of adhesives or may be screwed on by a threaded means.

Figure 2:
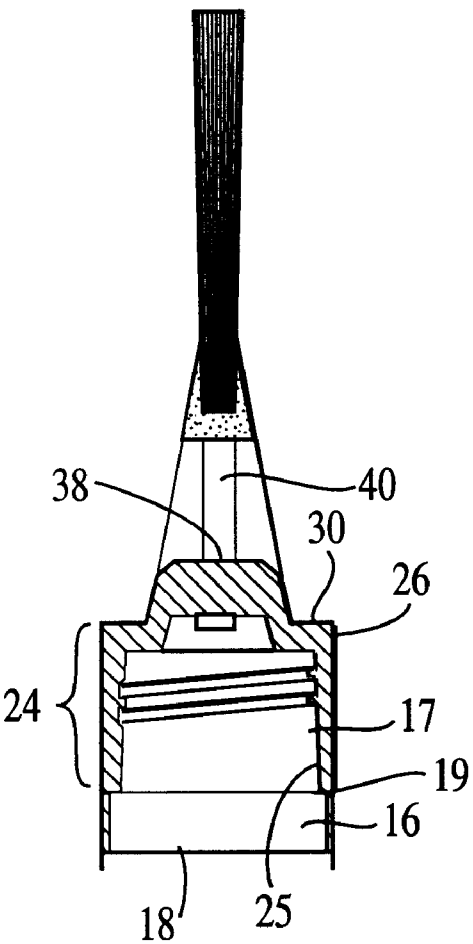
FIG. 2 is a cross section along line 2—2 of FIG. 1 of the brush and cap of one embodiment of the present invention.

As shown in FIG. 2, in the illustrated embodiment, the cap 12 includes a grip portion 24. The grip portion 24 is provided with an internal diameter 25 and external diameter 26. In one embodiment, the grip portion has a plurality of ridges (not shown) to aid the user in adjustment, whether tightening or loosening, of the cap onto the bottle 16. In the illustrated embodiment, the grip portion 24 is generally annular.

As shown in FIGS. 2 and 3, the cap 12 is further provided with a top portion 28 perpendicular to the grip portion 24. The top portion 28 of the cap has an interior surface 29 and an exterior surface 30. Further, in one rendition of the invention, the top portion 28 of the cap 12 is generally planar and flat.

As shown in FIGS. 3 and 4, in the illustrated embodiment, a coupling mechanism 32 is provided to join the cap 12 to the neck 17 of the bottle 16. A first thread 33 is located about the interior 25 diameter of the grip portion 24. The first thread 33 of the grip 24 may be associable with a second thread 34 commonly located on the neck 17 of the two-ounce acrylic paint bottles 6. Other renditions of the present invention envision a plurality of mechanisms for attachment of the cap 12 to the bottle 16, including, but not limited to, snap-on, press-on and clamp-on caps.

In the illustrated embodiment, the bottle 16 consists of a deformable acrylic paint bottle. A cavity 18 is located in the deformable acrylic paint bottle 16. In standard acrylic paint bottles 16, the cavity 18 holds a volume of approximately two ounces. The bottle 16 includes a mouth 19 for access to the cavity 18. A neck 17 projects from the mouth 19 and away from the cavity 18. Commonly, a second thread 34 is located about the neck 17 of standard acrylic paint bottles 16. By deformable it is generally meant capable of being distorted or altered in shape. Frequently, deformable acrylic paint bottles 16 or containers have elastomeric properties in which their shape can be temporarily altered so as to push or squeeze fluid out of the container and then regain their shape.

Figure 5:
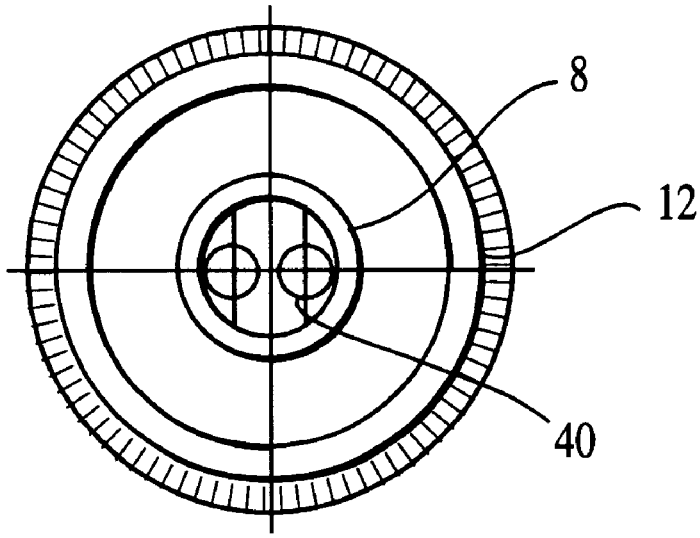
FIG. 5 is a cross section along line 5—5 of FIG. 4 of the cap of one embodiment of the present invention.
Figure 6:
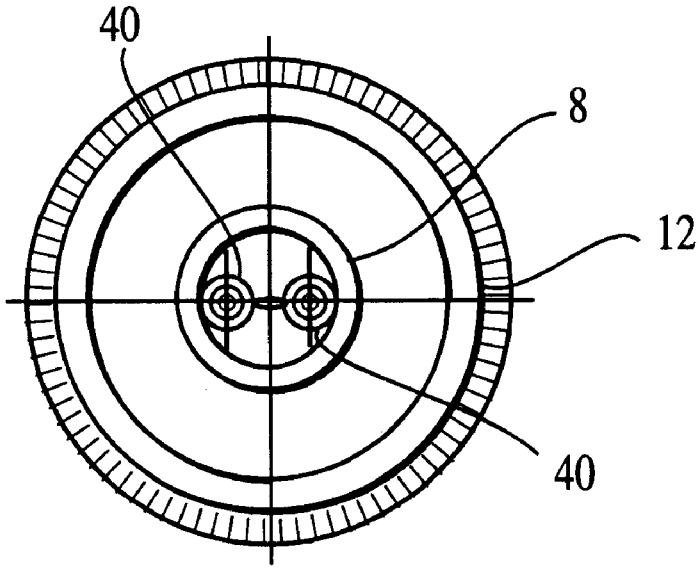
FIG. 6 is a cross-section along line 5—5 of FIG. 4 of the cap showing a tube within a tube.

As shown in FIGS. 2, 4 and 5, in the illustrated embodiment, the dispensing mechanism 36 includes at least one channel 37 located in the top portion 28 of the cap 12. At least one first channel opening 38 congruent with at least one channel 37 is provided at the interior surface 29 of the top portion 28 of the cap 12. At least one second channel opening 39 congruent with the at least one channel 37 is provided at the exterior surface 30 of the top portion 28 of the cap 12. At least one dispensing tube 40 is in fluid communication with the channel 37 in the top portion 28 of the cap 12. The dispensing tube 40 has a length of generally the length of the ferrule 8. In the illustrated embodiment, the dispensing tube 40 has a distal end 41 of the tube congruent with the distal end 10 of the ferrule 8. The tube 40 advances the acrylic paint contained within the bottle 16 to the bristles 6 of the brush 4 for application.

In the illustrated embodiment of the invention, two dispensing tubes 40, 40 are in fluid communication with two channel openings 38, 39 located on the exterior surface 30 of the top portion 28 of the cap 12. The two dispensing tubes 40, 40 are arranged so as to form an approximately 25° angle between them. In further renditions of the invention, it is envisioned that a first dispensing tube 40 may envelop a second dispensing tube (not shown) of slightly smaller diameter within it. Additionally, any number of dispensing tubes 40 forming an array of tubes of acute angles between them may be used. Additionally, each of the tubes 40 or some of the tubes 40 in the array may have one or a plurality of tubes contained within them. The invention is not to be limited by the number or arrangement of the dispensing tubes 40.

In one embodiment, the seal between the cap 12 and the bottle 16 includes at least one o-ring 15. The o-rings are seatable within the interior 25 portion of the grip 24 of the cap 12. They lay generally against the top portion 28 of the cap 12.

The acrylic paint contained in the bottles 16 may be of a variety of colors. Further, the acrylic paints may be of a plurality of nontoxic formulations that will not cause the deterioration of the bottle 16.

In one embodiment of the invention, the invention includes a reducer ring (not shown) associable with the neck 17 of the acrylic paint bottle 16. The reducer ring has an internal diameter and an external diameter. A third complimentary threaded portion to the second thread 34, located on the neck 17, is provided on the internal diameter of the reducer ring. In this manner, the reducer ring is associated with the acrylic paint bottle 16 by threading the two together. Then, located on the external diameter of the reducer ring, is a fourth complimentary threaded portion to the first thread 33 located on the interior of the cap 12. The cap 12 is then threaded to the bottle 16 in combination with the reducer ring. In this rendition of the invention, it is envisioned that the reducer ring would facilitate the association of the cap 12 and applicator to a plurality of bottles 16 of varying volumes and varying neck diameters.

In one embodiment of the invention, a valve (not shown) may be housed within the cavity 18 of the bottle 16. The valve would assist in the dispensing of the acrylic paint. It may assist by, among others, controlling the speed, pressure, or volume of paint dispelled.

The present invention includes a method of providing an acrylic paint, the method including the steps of providing a two-ounce acrylic paint bottle 16 housing an acrylic paint, providing an interchangeable cap fluid applicator 1 of the present invention, attaching the interchangeable cap fluid applicator 1 of the present invention to the bottle 16, deforming the bottle 16 to advance the acrylic paint through the dispensing tubes 40 located in the cap 12 and brush 4 to the bristles 6 of the brush 4 for application, and applying the acrylic paint to the surface of an object to be painted.

The discussion above is descriptive, illustrative and exemplary and is not to be taken as limiting the scope defined by the appended claims.

What is claimed is:

1. An interchangeable cap fluid applicator system for use with acrylic paints, said cap fluid applicator system comprising:

a deformable paint bottle;

a cavity defined by said paint bottle, said cavity having a capacity of approximately two ounces;

a burrow opening into said cavity;

a neck projecting away from the cavity of the burrow, said neck defining a threaded portion;

a cap having a generally flat top portion and an annular grip portion and a threaded portion defined on an interior of said cap;

at least one channel defined in the top portion of the cap to extend through the top portion, said channel defining a fluid connection from the cavity and through the top portion of the cap;

a ferrule having a proximal and a distal end, said proximal end molded to the exterior surface of the top portion of the cap over said channel, said ferrule holding a plurality of bristles, said bristles protruding from the ferrule to form a brush;

at least one elongated tube fluidly connected to the channel in the top portion of the cap, said tube having a length extending generally along the length of the ferrule and having a distal end proximate the distal end of the ferrule; and wherein the at least one tube further comprises a first tube and a second tube;

said first tube having an external diameter smaller than the internal diameter of the second tube wherein the first tube is inserted within the second tube;

wherein said cap, channel and tube cooperate to deliver a fluid contained within the container to the bristles of the brush.

2. The cap fluid applicator system of claim 1 wherein the at least one tube comprises at least two tubes.

3. The cap fluid applicator system of claim 2 wherein said two tubes are arranged so as to form an acute angle with respect to each other.

4. The cap fluid applicator system of claim 3 wherein said two tubes are arranged so as to form an angle of generally 5 to 25 degrees with respect to each other.

5. The cap fluid applicator system of claim 1 wherein the bristles are arranged so as to taper at their distal end to form a fine-point brush.

6. The cap fluid applicator system of claim 1 wherein the bristles are arranged to splay at a generally acute angle for application of the acrylic paint.

7. A method of applying an acrylic paint, said method comprising:

providing a bottle housing an acrylic paint;

providing a brush having a plurality of bristles attached to a cap, said cap adapted to threadably mount to said container;

attaching the cap to the bottle;

deforming the bottle to advance the acrylic paint through a plurality of tubes arrangeable at acute angles to each other, at least portions of which are located in the cap to advance the paint towards the bristles of the brush; and applying the acrylic paint to a surface of an object to be painted.

8. The method of claim 7 further comprising:

removing the cap from association with the bottle;

providing a second deformable two-ounce standard size bottle, the second bottle containing a fluid, the second bottle having a second standard cap associated with the second bottle;

removing the second standard cap from the second standard size bottle;

providing a third cap with a fluidly connected tube integral with a brush;

attaching the third cap to said second bottle; and deforming the second bottle to dispense the fluid through the third cap with a fluidly connected tube integral with a brush to an object.

9. The method of claim 8 wherein the fluid is an acrylic paint.

10. The method of claim 9 wherein the acrylic paints are different colors.

11. The method of claim 9 wherein the acrylic paints are the same color.

12. The method of claim 8 wherein the fluid is selected from the group consisting of a finish, stain, varnish and lacquer.

13. An interchangeable cap fluid applicator system for use with acrylic paints, said cap fluid applicator system comprising:

a deformable paint bottle;

a cavity defined by said paint bottle, said cavity having a capacity of approximately two ounces;

a burrow opening into said cavity;

a neck projecting away from the cavity of the bourrow, said neck defining a threaded portion;

a cap having a generally flat top portion and an annular grip portion and a threaded portion defined on an interior of said cap;

at least one channel defined in the top portion of the cap to extend through the top portion, said channel defining a fluid connection from the cavity and through the top portion of the cap;

a ferrule having a proximal and a distal end, said proximal end molded to the exterior surface of the top portion of the cap over said channel, said ferrule holding a plurality of bristles, said bristles protruding from the ferrule to form a brush;

at least two elongated tubes fluidly connected to the channel in the top portion of the cap, said tubes having a length extending generally along the length of the ferrule and having a distal end proximate the distal end of the ferrule;

said tubes arrangeable so as to form an acute angle with respect to each other; wherein said cap, channel and tube cooperate to deliver a fluid contained within the container to the bristles of the brush.

14. The cap fluid applicator system of claim 13 wherein said two tubes are arranged so as to form an angle of generally 5 to 25 degrees with respect to each other.

15. The cap fluid applicator system of claim 13 wherein the at least two tubes further comprise a first tube and a second tube;

said first tube having an external diameter smaller than the internal diameter of the second tube wherein the first tube is inserted within the second tube.

16. The cap fluid applicator system of claim 13 wherein the bristles are arranged so as to taper at their distal end to form a fine-point brush.

17. The cap fluid applicator system of claim 13 wherein the bristles are arranged to splay at a generally acute angle for application of the acrylic paint.

18. The cap fluid applicator system of claim 13 further comprising:

a reducer ring associable with the neck of the acrylic paint container, said reducer ring having an internal diameter and an external diameter;

a complimentary threaded portion to the neck threading located on the internal diameter of the reducer ring; and a complimentary threaded portion to the grip threading located on the external diameter of the reducer ring, wherein said reducer ring facilitates the attachment of the cap to the neck of the bottle.

* * * * *